United States Patent [19]

Zimmer

[11] 3,969,999

[45] *July 20, 1976

[54] DYESTUFF APPLICATOR FOR SCREEN PRINTER

[76] Inventor: Peter Zimmer, Untere Sparchen 54, A 6330 Kufstein, Austria

[ * ] Notice: The portion of the term of this patent subsequent to Jan. 24, 1992, has been disclaimed.

[22] Filed: Jan. 31, 1974

[21] Appl. No.: 438,282

[30] Foreign Application Priority Data

Feb. 7, 1973 Austria ..... 1096/73

[52] U.S. Cl. ..... 101/120; 101/123; 101/124; 118/213; 118/406

[51] Int. Cl.[2] ..... B41F 15/40; B41F 15/44

[58] Field of Search ..... 101/114, 115, 116, 119, 101/120, 123, 124; 118/410, 406, 411, 412, 213

[56] References Cited

UNITED STATES PATENTS

| | | | |
|---|---|---|---|
| 2,203,910 | 6/1940 | Issartel et al. | 101/114 X |
| 2,796,846 | 6/1957 | Trist | 118/410 |
| 2,928,340 | 3/1960 | Stein et al. | 101/120 |
| 3,381,336 | 5/1968 | Wells | 118/411 UX |
| 3,553,006 | 1/1971 | Beau et al. | 118/411 X |

*Primary Examiner*—Edgar S. Burr
*Assistant Examiner*—R. E. Suter
*Attorney, Agent, or Firm*—Ernest G. Montague; Karl F. Ross; Herbert Dubno

[57] ABSTRACT

A dyestuff applicator, located inside a cylindrical printing screen, comprises a horizontal tube which supports an axially extending dyestuff-distributing member immediately overlying the inner screen surface. The distributing member, or at least a membrane-shaped bottom thereof, is under pressure of the liquid dyestuff supplied to the tube at a superatmospheric pressure equivalent to a head of at least 1000 mm water. To insure full effectiveness of this pressure over the length of an outlet zone in the bottom of the distributing member, the body of liquid overlying that zone within the applicator should have a cross-section exceeding in at least one dimension 1.5% of the length of a flow path as measured from a point of entry of the dyestuff into the space containing that body of liquid.

5 Claims, 4 Drawing Figures

DYESTUFF APPLICATOR FOR SCREEN PRINTER

FIELD OF THE INVENTION

My present invention relates to a dyestuff applicator for a printing machine, more particularly a screen printer in which an apertured printing screen overlies a substrate to be imprinted and is movable together with that substrate in a predetermined direction

BACKGROUND OF THE INVENTION

In my copending application Ser. No. 426,909, filed Dec. 13, 1973, I have disclosed a printing machine of this type wherein a supply tube is horizontally disposed inside a cylindrical printing screen and supports a dyestuff applicator divided into two relatively vertically movable parts, i.e. a guide structure secured to the underside of the supply tube and an elongate distributing member carried on that structure. The distributing member forms an outlet for the dyestuff along a narrow zone which is centered on a vertical axial plane of the supply tube and which can thus move up and down, in response to irregularities in the underlying substrate, substantially independently of that tube. The movement of the distributing member can be restrained, however, by interposed springs supplementing the weight of the overlying body of liquid, as likewise disclosed in the copending application.

OBJECT OF THE INVENTION

The object of my present invention is to provide means in such a dyestuff applicator for insuring an even distribution of fluid pressure along the outlet zone in order to produce clean and uniform prints.

SUMMARY OF THE INVENTION

I realize this object, in accordance with my present invention, by connecting the applicator-supporting tube to a source of liquid dyestuff under superatmospheric pressure. The pressure of the liquid, preferably equivalent to a head of at least 1000 mm water, is transmitted to a fluid space within the applicator having a constant cross-section along the tube axis to accommodate a body of dyestuff above the outlet zone, this space communicating with the outlet over the length of that zone.

The fluid space can be formed either by the tube itself, which in this instance has a series of axially spaced apertures aligned with vertical channels in the distributing member, or else by a housing surrounding the tube, the bottom of this housing being an elastic membrane which supports the body of dyestuff and defines the outlet.

I have found that, in either case, optimum performance is obtained if the cross-section of the fluid space (i.e. the inner diameter of the tube or the width or height of the housing) exceeds in at least one dimension 1.5% of the length of a longitudinal flow path of the dyestuff in that space. If dyestuff is admitted into the applicator at one end only, the flow path extends over the full length of the outlet; if it is admitted centrally or from opposite ends, there are two branched flow paths each measuring half the length of the outlet.

BRIEF DESCRIPTION OF THE DRAWING

The above and other features of my invention will now be described in detail with reference to the accompanying drawing in which.

SPECIFIC DESCRIPTION

Figure 1:
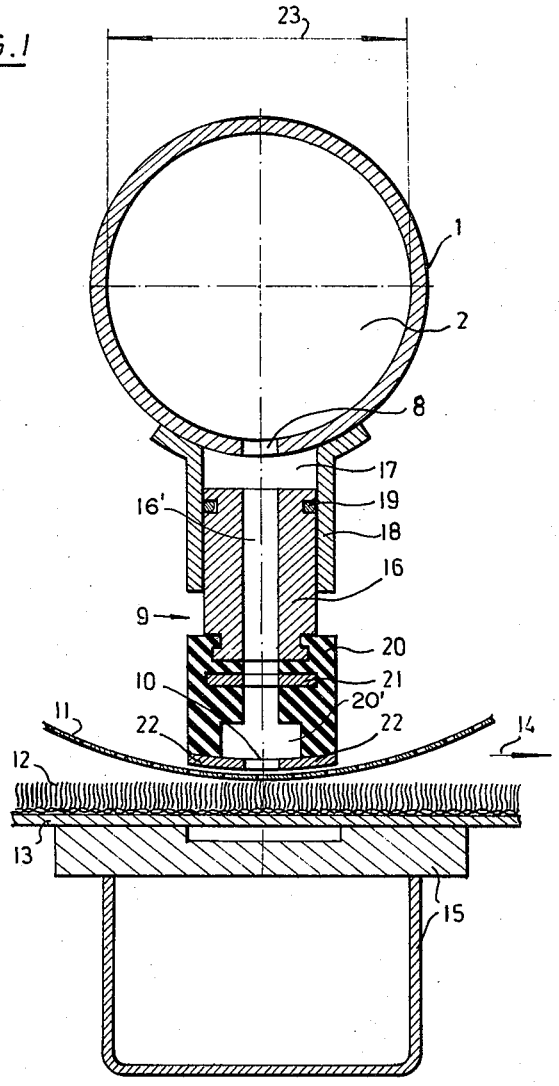
FIG. 1 is a cross-sectional elevational view of a dyestuff applicator embodying my invention.
Figure 2:
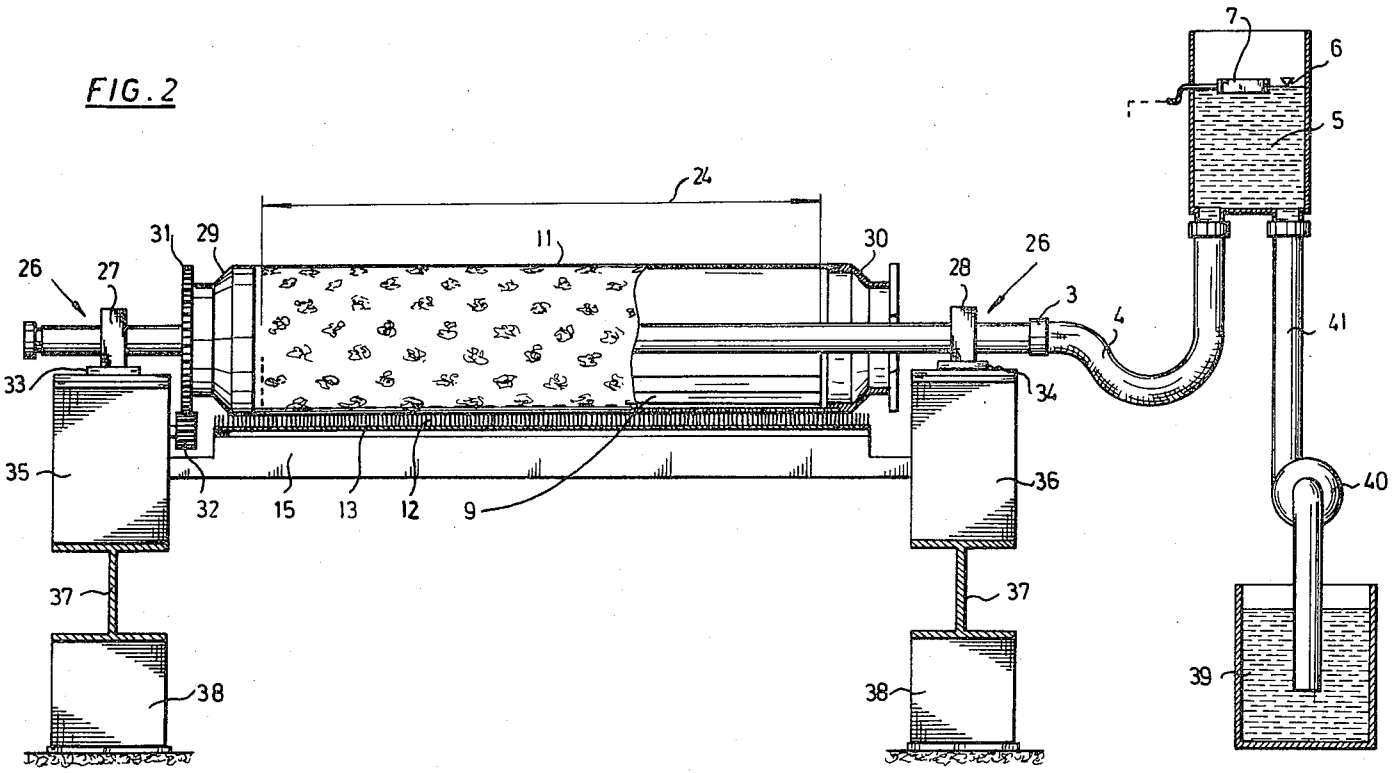
FIG. 2 is a side-elevational view, partly in section, of the applicator shown in FIG. 1.

FIGS. 1 and 2 show a dyestuff applicator comprising a supply tube 1 whose interior 2 receives dyestuff under super-atmospheric pressure, equivalent to a head of at last 1000 mm of water, via a coupling 3 and a feeding conduit 4 from an elevated container 5 wherein a predetermined liquid level 6 is maintained by means of a float switch 7. Inside a cylindrical printing screen 11, the liquid flows through apertures 8 from tube 1 into an axially extending distributor member 9 whose bottom is formed by a pair of strips 22 separated by a discharge gap 10. From there the liquid passes through openings in the screen 11 to an inderlying substrate 12, such as a web of pile fabric, carried by the top 13 of a printing table 15 in the direction of arrow 14. The vertically movable distributor member 9 comprises a plurality of small pistons 16 which are slidable in corresponding cylinder bores 17 of a guiding block 18 and are provided with sealing rings 19. The guiding block 18 is rigidly connected with the supply tube 1. The lower part 20 of the movable member 9 comprises a rubber profile in which a flat shutter 21 is slidable for obstructing, during periods of non-use, center bores 16′ of pistons 16 through which the liquid from tube 1 can reach a distributing channel 20′ in part 20 leading to the gap 10. The effective flow cross-section is determined by the inner diameter 23 of tube 1 which, according to a feature of the present invention, should equal at least 1.5% of the length 24 of the discharge gap 10. The length 24 constitutes here the length of the effective flow path through the applicator since the liquid is fed in from one side, namely from the right in FIG. 2, and the pressure drop in the supply tube occurs from right to left only. The tube 1 is mounted at its ends 25 and 26 on holders 27 and 28. Heads 29 and 30 are provided at both ends of the screen 11. The head 29 carries a gear 31 which engages a pinion 32 in the base frame of the machine. The tube holders 27 and 28 are fastened to a pair of plates 33 and 34 which are movable with reference to the machine frame in the vertical direction so that the screen and the applicator can follow any thickness variations in the substrate 12. The machine frame comprises transmission boxes 35, empty boxes 36, throughgoing I-beams 37 and feet 38. The liquid from a dyestuff reservoir 39 is fed to the laterally arranged elevated container 5 by means of a pump 40 and a riser conduit 41.

It will be evident that the liquid supplied under pressure to tube 1, acting upon the upper faces of pistons 16, exerts a downward force upon these pistons and through them on the strips 22 slidingly resting on the inner surface of screen 11. Thus, the liquid pressure tends to move the distributor member 9 downwardly with reference to guide block 18 and supply tube 1.

Figure 3:
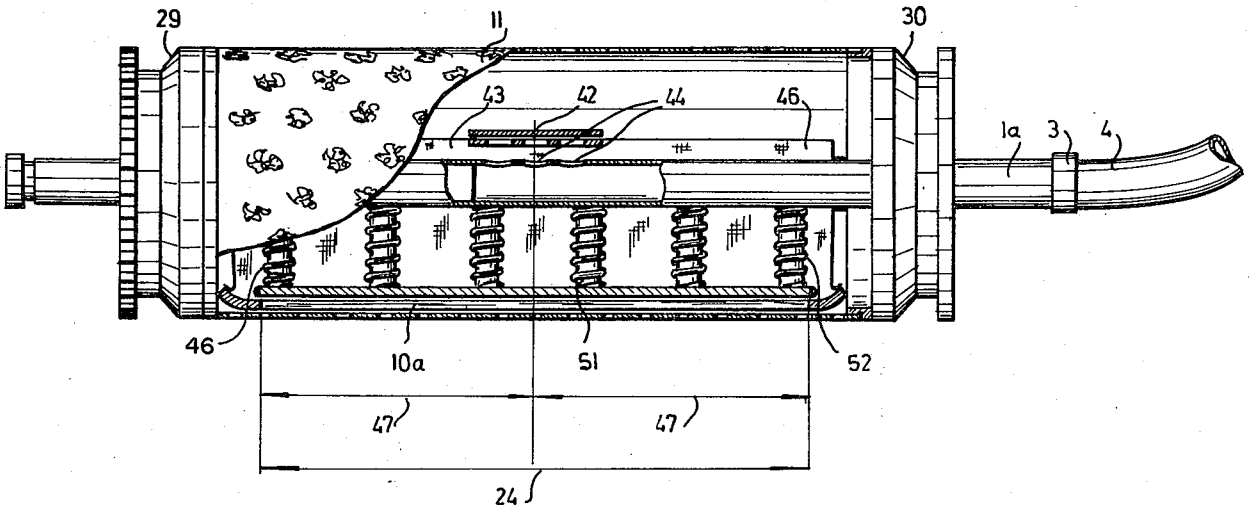
FIG. 3 is a side-elevational view generally similar to FIG. 2, illustrating another embodiment.
Figure 4:
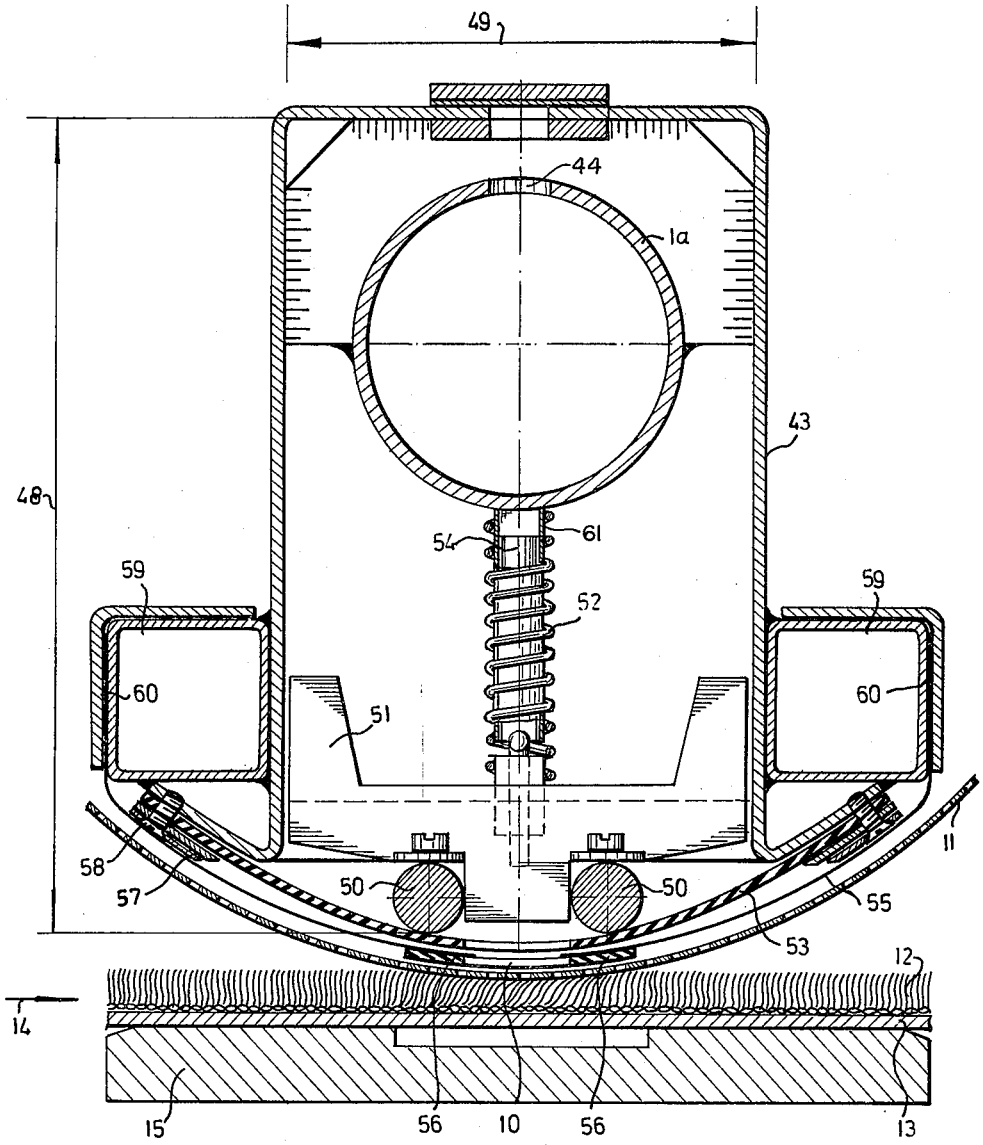
FIG. 4 is a cross-sectional view of the embodiment of FIG. 3, drawn to a larger scale.

In FIGS. 3 and 4 I have shown another embodiment of the present invention including a supply tube 1*a* connected via coupling 3 to feeding conduit 4. In this tube 1*a*, dyestuff flows to the center of a distributor housing 43 where it exits through ports 44 from tube 1 and branches into two partial streams which flow toward the left-hand end 45 and the right-hand end 46 of this housing as viewed in FIG. 3. The liquid entering the housing 43 is continuously discharged therefrom, at the nadir of screen 11, through a gap 10*a* for passage by way of the screen apertures to the underlying substrate 12. In this case the body of liquid overlying the discharge gap is contained in the housing 43 whose dimensioning, therefore, is significant to insure the desired uniformity of distribution. I have found that the dimensioning of this housing relative to the length 47 of each branch of the flow path in the interior of housing 43 should be such that the larger dimension of its cross-section (and therefore of the cross-section of the body of liquid therewithin, here specifically its height 48), exceeds 1.5 % of the length 47 of the longest flow path so that an even and clear print results. Particularly good printing results are obtained if the width 49 of the distributor housing 43 exceeds 1.5% of the length 24 of the discharge gap.

In the interior of housing 43 there are located two round horizontal rods 50 which are held uniformly separated over their entire length by spacing means 51 and which press against a rubber membrane 53, spanning the bottom of distributor housing 43, both under their own weight and under pressure of coil springs 52 embracing rods 54 which are received in sleeves 61 rigid with tube 1*a;* sleeves 61 form a structure insuring uniform vertical guidance of the membrane-loading means 50 51. Below the apertured rubber membrane 53 there is disposed a metal sheet 55 which carries sliding strips 56 on opposite sides of gap 10*a*. These strips serve not only for preventing leakage from the gap 10*a* to the inner surface of screen 11 but also to provide a small frictional coefficient so as to minimize the tangential forces which are exerted by the screen on the applicator. The gap 10*a* registers with a perforation in metal sheet 55 by means of which the dyestuff passes from the inerior of housing 43 to the substrate 12 through the screen 11. The flexible rubber membrane 53 is held laterally by clamping plates 57 and screws 58. The edges of sheet 55 are gripped between lateral reinforcing means 59 of square cross-section, secured to housing 43, and angles 60; the assembly has a certain mobility in the vertical direction, as described above, so as to follow changes in the thickness of the substrate.

It will be apparent that in FIGS. 3 and 4 the bottom 53 of the distributor member 43, 53 of the applicator is pressed downwardly, with reference to supply tube 1*a*, by the weight of the pressurized liquid and also by the springs 52; the spring pressure could be replaced by a magnetic force.

The applicator according to my invention could also be used with flat, rather than cylindrical, printing screens. Furthermore, the desired liquid pressure could be provided by a pump, with the container 5 disposed at the level of the applicator. The discharge region need not be a continuous gap but could be formed by a pattern of juxtaposed outlet openings. Dyestuff could be admitted to the supply tube from opposite ends, or from the center with exit openings provided at the tube ends to let the liquid flow from both sides toward the middle of the applicator.

I claim:

1. In a printing machine, in combination:

an apertured printing screen overlying a substrate to be imprinted along a contact area, said screen and said substrate being movable in a predetermined direction;

a source of liquid dyestuff under superatmospheric pressure;

a dyestuff applicator including a housing with a bottom closed by an elastic membrane engaging said screen in said contact area along a narrow zone perpendicular to said direction, said membrane being provided in said zone with an outlet extending substantially completely across said screen, a horizontal supply tube in said housing with an axis paralleling said outlet, said tube communicating with said source and with the interior of said housing to fill said interior with said dyestuff, and a downwardly extending guide structure fixedly mounted on said tube; and loading means in said housing slidably engaging said guide structure, said loading meand supplementing the pressure exerted by said dyestuff upon said membrane in urging same into firm contact with said screen around said outlet.

2. The combination defined in claim 1 wherein said housing has a generally rectangular cross-section transverse to said axis exceeding in at least one dimension 1.5% of the length of a longitudinal flow path of said dyestuff in said fluid space.

3. The combination defined in claim 2 wherein said source has a supply pressure at least equivalent to a head of 1000 mm water.

4. The combination defined in claim 1 wherein said loading means comprises a pair of horizontal rods resting on said membrane on opposite sides of said zone and spring means inserted between said rods and said tube for intensifying the pressure exerted upon said membrane.

5. The combination defined in claim 4 wherein said guide structure comprises a plurality of vertical sleeves depending from the underside of said tube, said spring means comprising individual coil springs surrounding said sleeves, said loading means including vertical rods rigid with said horizontal rods movably received in said sleeves.

* * * * *